US009919399B2

(12) United States Patent
Buxton et al.

(10) Patent No.: US 9,919,399 B2
(45) Date of Patent: Mar. 20, 2018

(54) ROLL POLISHER APPARATUS AND METHOD

(71) Applicant: Nucor Corporation, Charlotte, NC (US)

(72) Inventors: William Buxton, Decatur, AL (US); Jason D. Barron, Elkmont, AL (US)

(73) Assignee: NUCOR CORPORATION, Charlotte, NC (US)

( * ) Notice: Subject to any disclaimer, the term of this patent is extended or adjusted under 35 U.S.C. 154(b) by 67 days.

(21) Appl. No.: 14/029,565

(22) Filed: Sep. 17, 2013

(65) Prior Publication Data

US 2015/0079884 A1 Mar. 19, 2015

(51) Int. Cl.
*B24B 5/36* (2006.01)

(52) U.S. Cl.
CPC ..... *B24B 5/363* (2013.01)

(58) Field of Classification Search
CPC ..... B24B 5/00; B24B 5/363; B24B 5/37
USPC ..... 451/119, 120–124, 142, 143, 424–425
See application file for complete search history.

(56) References Cited

U.S. PATENT DOCUMENTS 1,212,131 A 1/1917 Coate
1,891,152 A 12/1932 Grove
2,286,596 A 6/1942 Brayshaw
2,297,976 A * 10/1942 Nachtman ..... C25D 5/52 15/77
2,329,530 A 2/1943 Haig
4,528,716 A 7/1985 Perneczky
4,633,999 A 1/1987 Perneczky
4,841,675 A * 6/1989 Perneczky ..... B24B 5/37 451/173
4,887,329 A 12/1989 Perneczky
5,015,303 A 5/1991 Perneczky
5,271,186 A 12/1993 Perneczky
5,341,607 A 8/1994 Perneczky
5,377,453 A 1/1995 Perneczky
5,383,306 A 1/1995 Michalon et al.
5,460,565 A 10/1995 Perneczky
(Continued)

FOREIGN PATENT DOCUMENTS

JP 2007268630 A * 10/2007

OTHER PUBLICATIONS

International Search Report and Written Opinion for International Application No. PCT/US14/55499 dated Dec. 3, 2014.
(Continued)

*Primary Examiner* — Monica Carter
*Assistant Examiner* — Lauren Beronja
(74) *Attorney, Agent, or Firm* — Moore & Van Allen PLLC; Jeffrey R. Gray

(57) ABSTRACT

Embodiments of the present invention relate to roll polishers that may be utilized with rollers in rolling stands that have restrictive space requirements. The roll polisher of the present invention comprises a tube with pivot actuators used to engage and disengage a rolling pad on the surface of a roller. Transverse actuators may be located at least partially within the tube, or in other embodiments located outside of the tube, and used to move the tube, and thus, the rolling pad, transversely back and forth across the surface of the roller. The roll polisher may operate apply a force to the pad engaging the rolling surface to remove defects and smooth the surface of the polisher.

21 Claims, 16 Drawing Sheets

(56) References Cited

U.S. PATENT DOCUMENTS

| | | | | |
|---|---|---|---|---|
| 5,618,224 | A * | 4/1997 | Dumas | B21B 28/04 451/142 |
| 5,964,960 | A | 10/1999 | Boeck | |
| 5,997,389 | A * | 12/1999 | Dal Pan | B21B 28/04 451/142 |
| 7,465,374 | B2 | 12/2008 | Porco | |
| 2007/0033751 | A1 | 2/2007 | Hof et al. | |
| 2008/0163509 | A1* | 7/2008 | Kube et al. | 33/555.1 |
| 2008/0230430 | A1 | 9/2008 | Chou et al. | |
| 2010/0077820 | A1* | 4/2010 | Porco | A46B 5/0054 72/112 |
| 2013/0192325 | A1 | 8/2013 | Porco | |

OTHER PUBLICATIONS

International Preliminary Report on Patentability for International Application No. PCT/US2014/055499 dated Mar. 22, 2016.

* cited by examiner

ROLL POLISHER APPARATUS AND METHOD

FIELD

The present invention is related to the field of roll polishers that are used to polish the surfaces of rollers that are used in manufacturing different types of sheet materials.

BACKGROUND

Rollers are used in various industries to produce flat smooth surfaces on various materials, such as for example, steel, copper, aluminum, brass, paper, plastics, or other like materials. In order to create the flat surfaces on these materials the rollers used during manufacturing should be free of defects and as smooth as possible. Roll polishers are often used to achieve and maintain the desired surface of the rollers used in manufacturing some materials.

SUMMARY OF THE EMBODIMENTS OF THE INVENTION

Embodiments of the present invention relate to roll polishers that may be utilized with rollers in rolling stands that have restrictive space requirements. The roll polisher of the present invention comprises a tube with pivot actuators used to engage and disengage a rolling pad on the surface of a roller. Transverse actuators may be located at least partially within the tube, or in other embodiments located outside of the tube, and are used to move the tube, and thus, the rolling pad, transversely back and forth across the surface of the roller. The roll polisher may operate in an envelope that is as small as 11 inches by 9 inches and span rollers from 50 to 120 inches wide. The pivot actuators may apply a force of approximately 100 lbs. to the rolling surface to remove defects and smooth the surface of the roller. In other embodiments the roll polisher my operate in envelopes that are smaller or larger than 11 inches by 9 inches or outside of the width of 50 to 120 inches. In still other embodiments the pivot actuators may apply a force of more or less than 100 lbs.

One embodiment of the invention is a roll polisher apparatus comprising a tube with a first end and a second end; a pivot actuator; a polishing bar operatively coupled to the tube through at least the pivot actuator, wherein the pivot actuator allows the polishing bar to be extended and retracted; a first support mount operatively coupled to the first end of the tube and a second support mount operatively coupled to the second end of the tube; and a transverse actuator operatively coupled to the tube and at least one of the first support mount or the second support mount to allow transverse movement between the tube and the first and second support mounts.

In further accord with an embodiment of the invention the roll polisher apparatus further comprises a transverse pin mount operatively coupled to the first support mount; and a transverse pin operatively coupled to the transverse actuator, wherein the transverse actuator is operatively coupled to the transverse pin mount of the first support mount through the transverse pin.

In another embodiment of the invention, the transverse pin mount is a horseshoe mount, and the transverse pin is operatively coupled to the horseshoe mount.

In yet another embodiment of the invention the roll polisher apparatus further comprises a transverse actuator aperture in the tube; and a transverse actuator mount operatively coupled to the tube, wherein the transverse actuator is positioned at least partially within the tube and operatively coupled to the transverse actuator mount.

In still another embodiment of the invention, the roll polisher apparatus further comprises a coupling head operatively coupled to the pivot actuator; a coupling head seat located within the polishing bar and configured to interact with the coupling head; a bearing operatively coupled to the coupling head; and a retaining ring configured to operatively couple the coupling head, the coupling head seat, and the bearing to the polishing bar.

In further accord with an embodiment of the invention, the roll polisher apparatus further comprises a linkage operatively coupling to the tube to the polishing bar to reduce transverse shear loading on the pivot actuator.

In another embodiment of the invention the roll polisher apparatus further comprises one or more tube wear pads operatively coupled to the first end or the second end of the tube, wherein the one or more tube wear pads comprise wear pad channels for receiving and distributing lubrication across the one or more wear pads.

In yet another embodiment of the invention at least one of the a first support mount or the second support mount comprises support mount channels, wherein the support mount channels receive the lubrication and deliver the lubrication to the wear pad channels in the one or more wear pads.

In still another embodiment of the invention the roll polisher apparatus further comprises a first stand receiving plate and a second stand receiving plate, wherein the first stand receiving plate is operatively coupled to the first support mount and the second stand receiving plate is operatively coupled to the second support mount.

In further accord with an embodiment of the invention, the roll polisher apparatus of claim 9, wherein at least one of the first support mount or the second support mount comprises a support mounting plate; and a support bar welded to the support mounting plate, wherein the support mounting plate is assembled to the stand receiving plate, the support bars are assembled to the tube, the roll polisher apparatus is held in position adjacent a roll, and the support bar is welded to the support mounting plate to orient the roll polisher apparatus adjacent the roll.

In another embodiment of the invention, the roll polisher apparatus of claim 1, further comprises a transverse pin mount operatively coupled to the first support mount or a first stand receiving plate; a transverse pin operatively coupled to the transverse actuator; a transverse actuator mount operatively coupled to the tube, wherein the transverse actuator is positioned at least partially outside of the tube and operatively coupled to the transverse actuator mount and operatively coupled to the transverse pin mount of the first support mount or the first stand receiving plate through the transverse pin.

Another embodiment of the invention is a roll polisher apparatus comprising a tube with a first end, a second end, transverse actuator apertures located at the first end and the second end, and transverse actuator mounts operatively coupled to the first end and the second end; two or more pivot actuators; a polishing bar operatively coupled to the tube through at least the two or more pivot actuators, wherein the two or more pivot actuators allow the polishing bar to be extended and retracted; a first support mount operatively coupled to, and at least partially located within, the first end of the tube; a second support mount operatively coupled to, and at least partially located within, the second end of the tube; a first transverse actuator located within the transverse actuator aperture at the first end of the tube, and operatively coupled to the transverse actuator mount at the first end of the tube; a second transverse actuator located within the transverse actuator aperture at the second end of the tube, and operatively coupled to the transverse actuator mount at the second end of the tube; and wherein the first transverse actuator and the second transverse actuator allow the transverse movement between the tube and the first support mount and the second support mount.

In further accord with an embodiment of the invention, the roll polisher apparatus further comprises transverse pin mounts operatively coupled to the first support mount and the second support mount; and transverse pins operatively coupled to the first transverse actuator and the second transverse actuator, wherein the first transverse actuator and the second transverse actuator are operatively coupled to the transverse pin mounts of the first support mount and the second support mount through the transverse pins.

In another embodiment of the invention, the roll polisher apparatus further comprises pivot couplings operatively coupling the two or more pivot actuators to the polishing bar, wherein the pivot couplings comprise a coupling head operatively coupled to the pivot actuator; a coupling head seat located within the polishing bar and configured to interact with the coupling head; a bearing operatively coupled to the coupling head; and a retaining ring configured to operatively couple the coupling head, the coupling head seat, and the bearing to the polishing bar.

In yet another embodiment of the invention the roll polisher apparatus further comprises a linkage operatively coupling the tube to the polishing bar to reduce transverse shear loading on the two or more pivot actuators.

In still another embodiment of the invention the roll polisher apparatus further comprises one or more tube wear pads operatively coupled to the first end and the second end of the tube, wherein the one or more tube wear pads comprise wear pad channels for receiving and distributing lubrication across the one or more wear pads.

In further accord with an embodiment of the invention the first support mount and the second support mount comprise support mount channels, wherein the support mount channels receive the lubrication and deliver the lubrication to the wear pad channels in the one or more wear pads.

In another embodiment of the invention the roll polisher apparatus further comprises a first stand receiving plate and a second stand receiving plate, wherein the first stand receiving plate is operatively coupled to the first support mount and the second stand receiving plate is operatively coupled to the second support mount.

In yet another embodiment of the invention the first support mount and the second support mount comprise a support mounting plate; and a support bar welded to the support mounting plate, wherein the support mounting plate is assembled to the stand receiving plate, the support bar is assembled to the tube, the roll polisher apparatus is held in position adjacent a roll, and the support bar is welded to the support mounting plate to orient the roll polisher apparatus adjacent the roll.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF THE SEVERAL VIEWS OF THE DRAWINGS

The accompanying drawings illustrate embodiments of the present disclosure, in which.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

FIGS. 1-16 illustrate embodiments of the roll polisher of the present invention, wherein the transverse actuators are positioned at least partially within the polishing tube to reduce the envelope of the roll polisher and allow for the use of the roll polishers on rollers in rolling stands that have space limitations. FIGS. 17-21 illustrate embodiments of the roll polisher of the present invention, wherein the transverse actuators are positioned at least partially outside of the polishing tube, which also provides a small envelope for the use of the roll polisher on rollers in rolling stands that have space limitation, but which may also allow for easier access to the transverse actuators when the roll polisher is installed.

Figure 1:
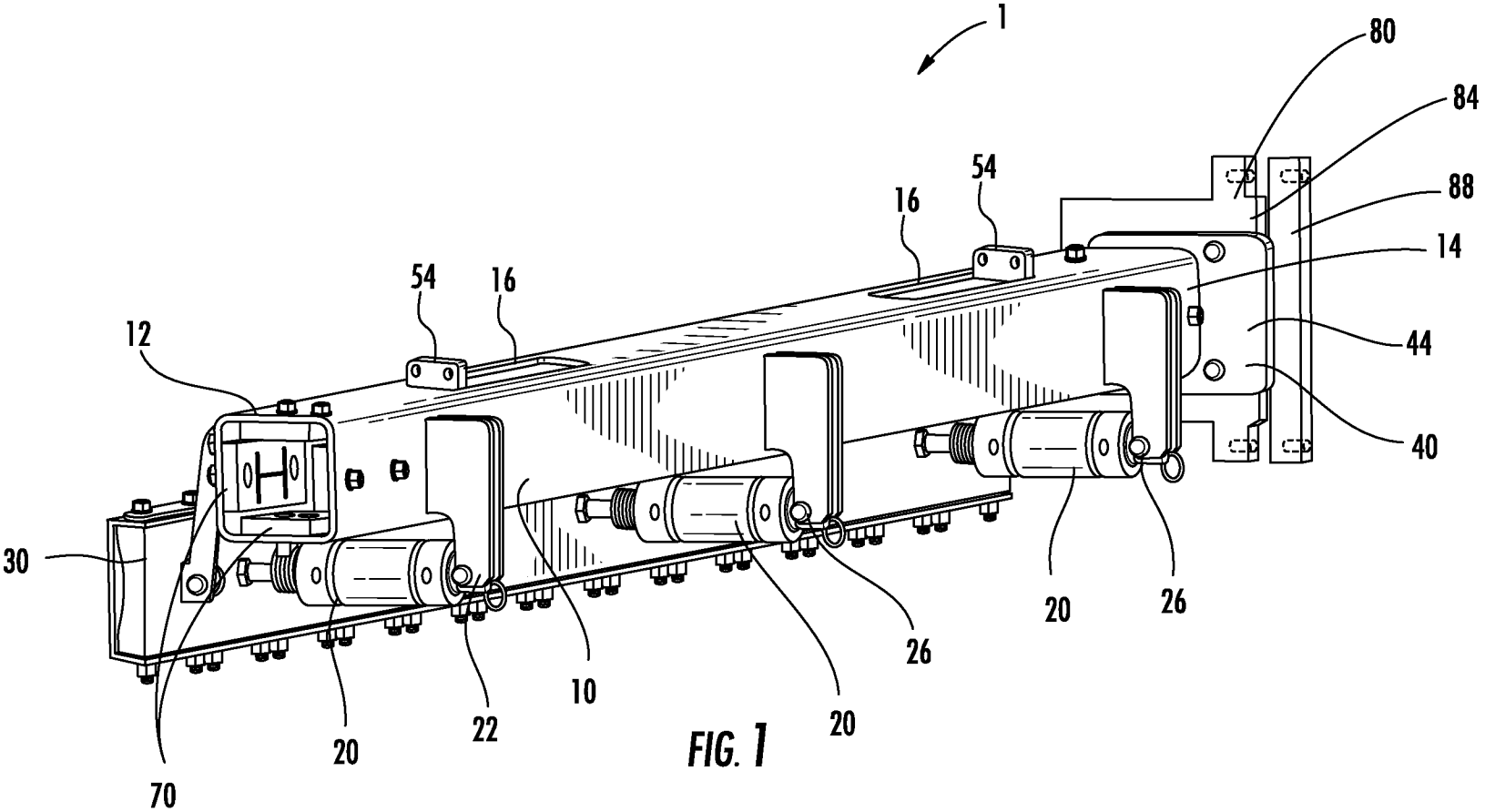
FIG. 1 illustrates a perspective view of a roll polisher with internal transverse actuators, in accordance with an embodiment of the invention.

FIG. 1 illustrates a rear perspective view of a roll polisher 1 with internal transverse actuators (not illustrated), in accordance with an embodiment of the invention. The roll polisher 1 illustrated in FIG. 1 has a tube 10 with a first end 12 and a second end 14. A polishing bar 30 is operatively coupled to the tube 10 through pivot actuators 20. The first end of the tube 10 is operatively coupled to a first support mount 42 (not illustrated in FIG. 1) and a second end 14 of the tube 10 is operatively coupled to a second support mount 44.

Figure 3:
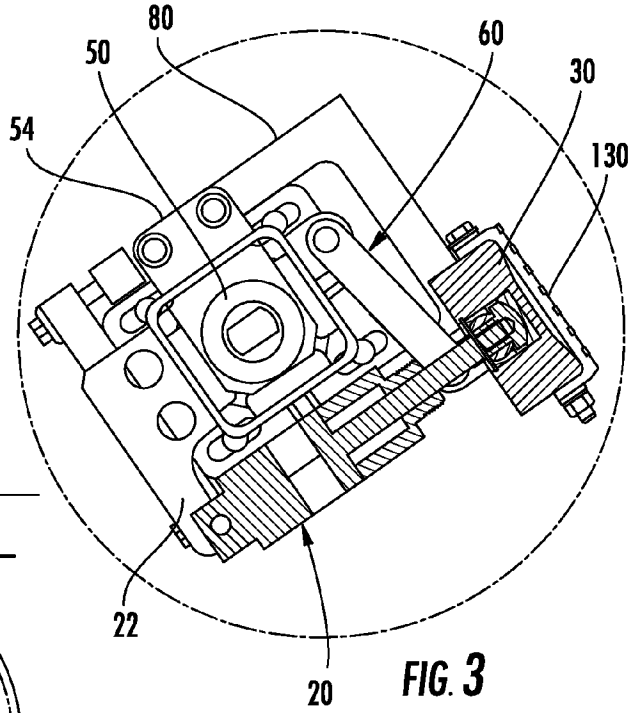
FIG. 3 illustrates an expanded cross-sectional view of the roll polisher installed in the rolling stand of FIG. 2, in accordance with an embodiment of the invention.
Figure 2:
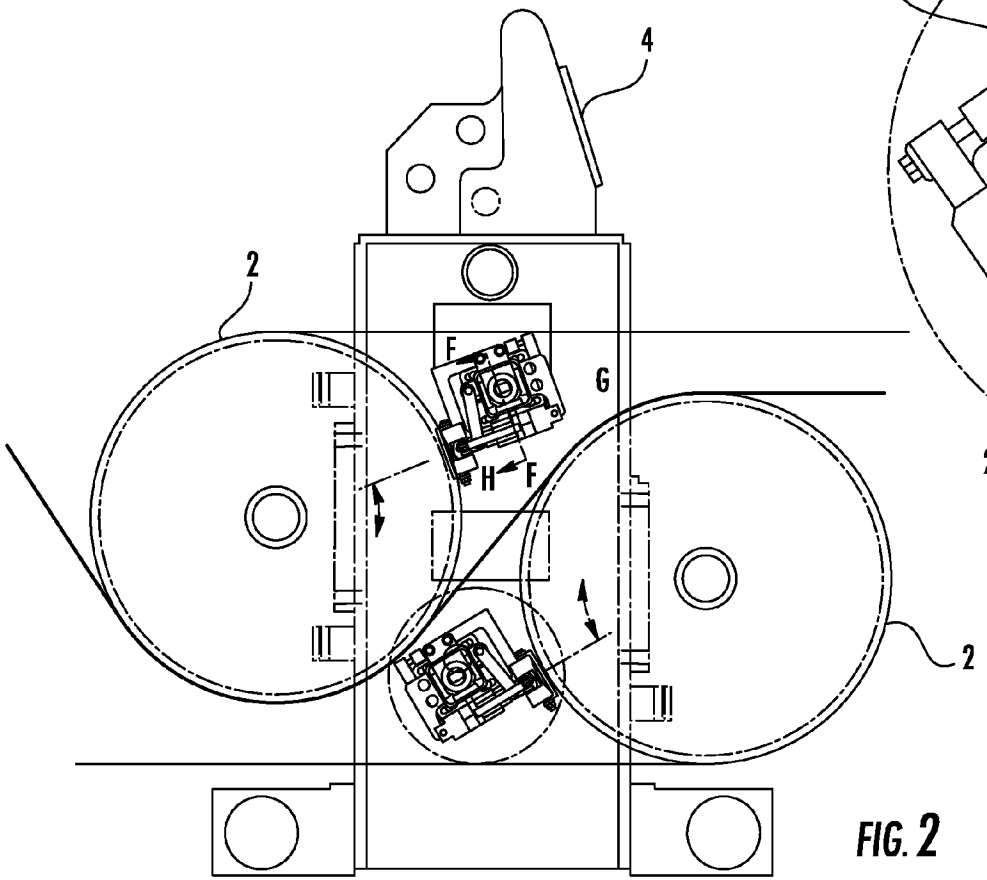
FIG. 2 illustrates cross-sectional view of a rolling stand with installed roll polishers, in accordance with an embodiment of the invention.
Figure 4:
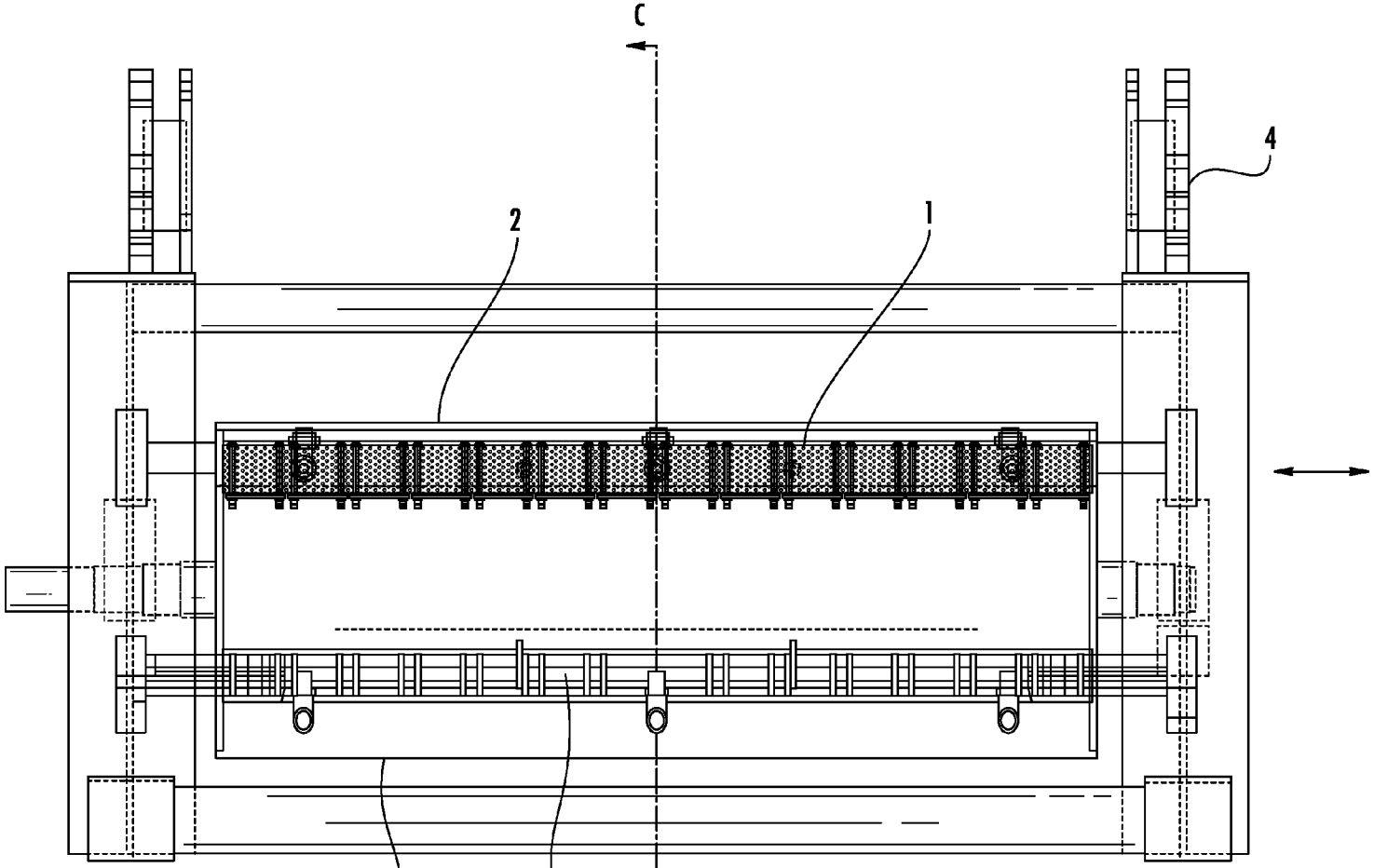
FIG. 4 illustrates an entry side view of a rolling stand with roll polishers installed and a roller removed, in accordance with an embodiment of the invention.

FIGS. 2 through 4 illustrate how the roll polishers 1 may be installed in a roll stand 4. FIG. 2 illustrates one embodiment of a cross section of a roll stand 4. The roll stand 4 illustrated in FIG. 4 includes two rollers 2. Roll stand 4 and rollers 2 may be utilized for various purposes in manufacturing different types of materials, such as but not limited to steel, paper, aluminum, plastic, or any other type of material that may require rolling, flattening, tempering, tensioning, leveling, or other like operations. Roll polishers 1 may be utilized to polish the rolls 2 by removing defects from the rolls 2 and smoothing the surface of the rolls 2. FIG. 2 also illustrates the small envelope in which the roll polishers 1 fit in order to polish the rollers 2 of a rolling stand 4. Not illustrated in FIG. 2 are other components that may also be located in the same envelope as the roll polishers 1, depending on the application for which the rollers are being used, such as but not limited to hoses used to provide hydraulic fluid or compressed air to the actuators, electrical connections to the rolling stand 4, hoses and applicators for lubrication that may be applied to the rollers 2 or the material passing through the rollers, instruments that may be used to monitor the rolls 2, the rolling stand 4, the material in the rollers, or other like components that limit the space in which the roll polishers 1 operate. In some embodiments the roll polisher 1 of the present invention may fit within an envelope of nine (9) inches by twelve (11) inches (or less or more) depending on the space requirements for various uses of the roll polishers 1. As illustrated in FIGS. 2 through 4 the roll polishers 1 may be provided on both the entry side of the rolling stand 4 and the exit side of the rolling stand 4 to polish the rolls in use. As explained in further detail later the roll polishers 1 may move in the transverse direction with respect to the rotating rolls 2 and further the roll polisher 1 is able to extend or retract the pivot actuators 20 in order to engage and disengage the rolling pad 130 onto the surface of roller 2 for polishing the surface of the rollers 2 by removing defects and smoothing the surface of the rollers 2.

Figure 5:
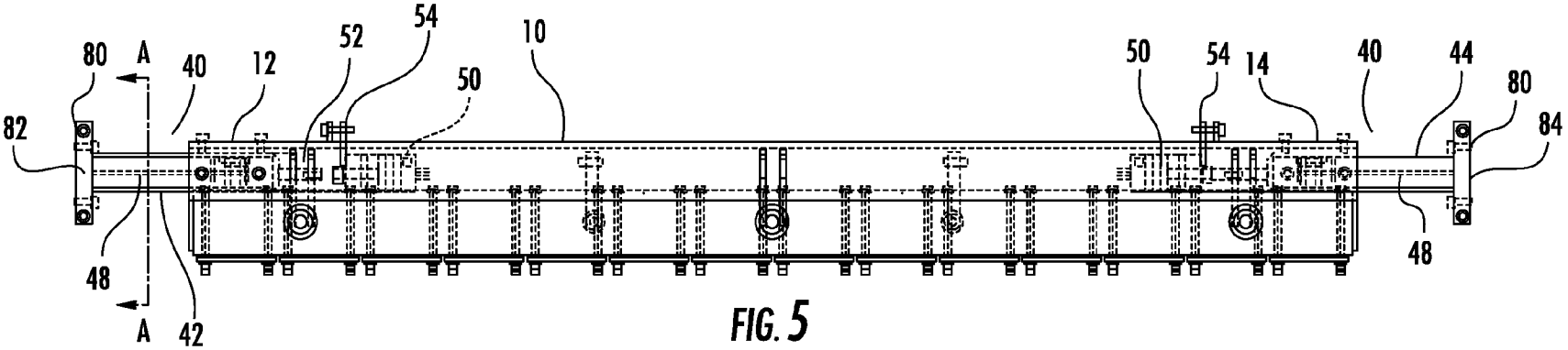
FIG. 5 illustrates rear view of the roll polisher, in accordance with an embodiment of the invention.
Figure 6:
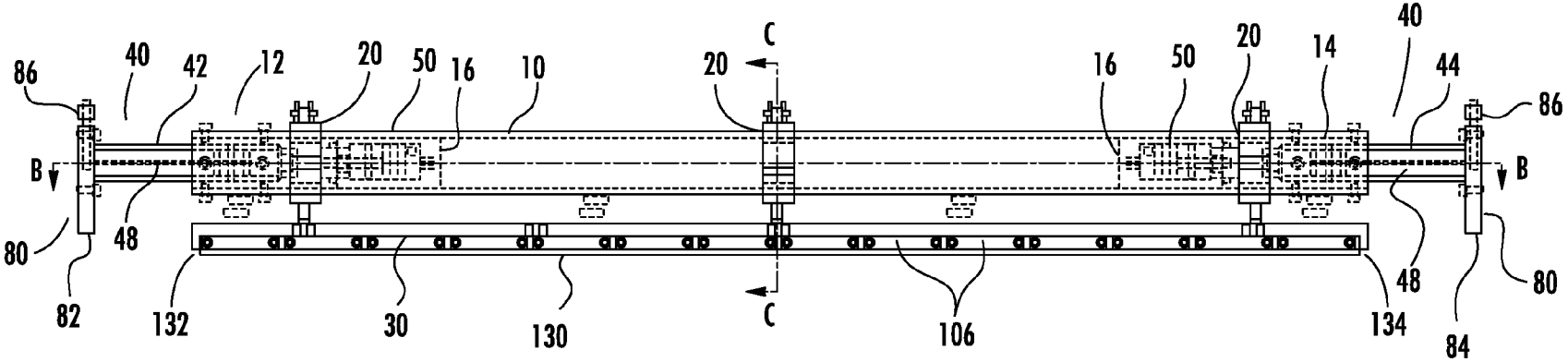
FIG. 6 illustrates a bottom view of the roll polisher, in accordance with an embodiment of the invention.
Figure 7:
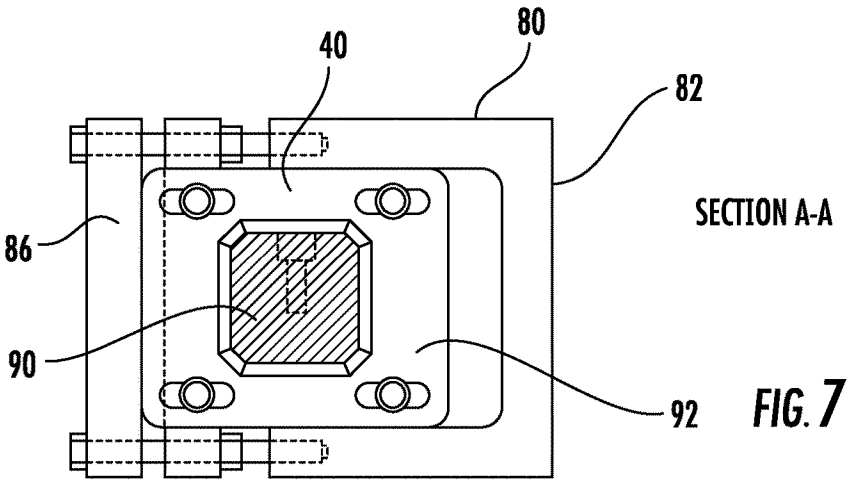
FIG. 7 illustrates a cross-sectional view of the roll polisher illustrated in FIG. 5, in accordance with an embodiment of the invention.

FIG. 5 illustrates a rear view of the roll polisher 1 and FIG. 6 illustrates a bottom view of the roll polisher 1 in accordance with one embodiment of the invention. As illustrated by FIGS. 5 and 6 the support mounts 40 are operatively coupled to the tube 10. For example, the support mounts 40 are located at least partially inside of the tube 10, which is at least partially hollow at the first end 12 and second end 14 of the tube 10. In the illustrated embodiment the tube 10 has a square cross-section and the support mounts 40 have a square cross-section that fit within the hollow opening of the tube 10 at the first end 12 and second end 14. In other embodiments of the invention the tube 10 and the support mounts 40 may have cross-sections that are different shapes, such as, but not limited to circular, oval, rectangular, pentagonal, octagonal, or other like shapes. Furthermore, the tube may be hollow, partially hollow, or solid based on the various embodiments described herein. In still other embodiments of the invention, the support mounts 40 may have a hollow section and the first end 12 and second end 14 of the tube 10 may be at least located partially inside of the support mounts 40. In other embodiments of the invention the tube 10 may be operatively coupled to support mounts 40 in other ways.

Figure 8:
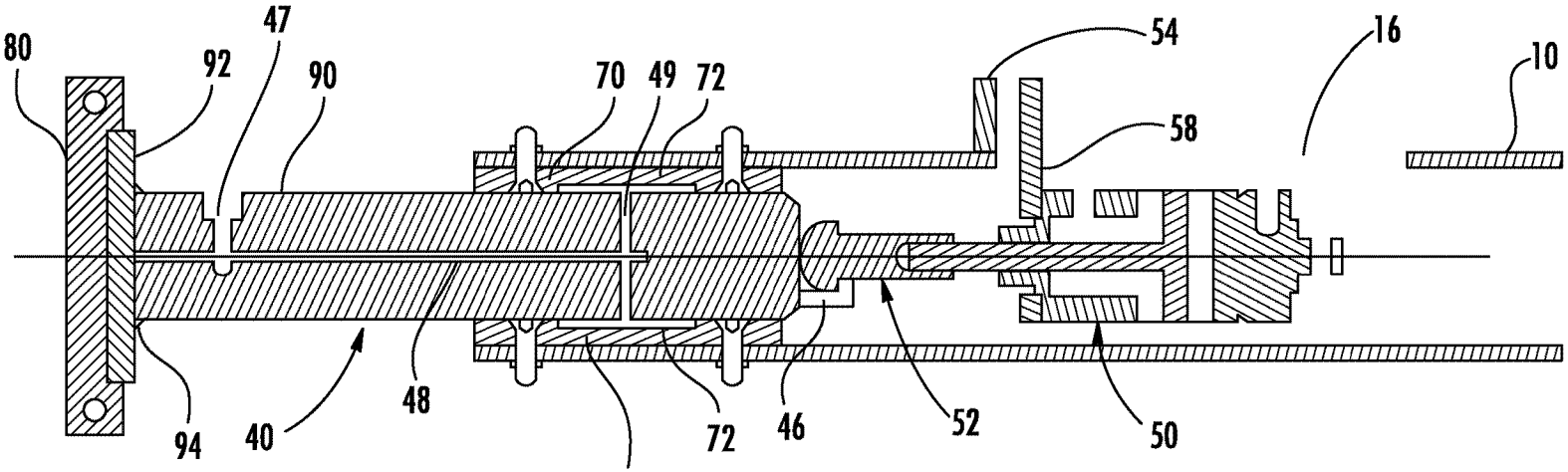
FIG. 8 illustrates a cross-sectional view of the roll polisher illustrated in FIG. 6, in accordance with an embodiment of the invention.

As further illustrated in FIGS. 5 and 6 the transverse actuators 50 are located within a hollow portion of the tube 10. As illustrated by FIG. 8 the transverse actuators 50 may be assembled through an opening 16 in the tube 10. The transverse actuators 50 are operatively coupled to the support mounts 40 to allow the roll polisher 1 to move in the transverse direction with respect to the roll 2. As illustrated in FIG. 8 the transverse actuator 50 is operatively coupled to the support mount 40 through the use of a transverse pin 52 that is operatively coupled to a transverse pin mount 46, which is operatively coupled to the support mounts 40. A perspective view of the support mount 40 and the transverse pin mount 46 is further illustrated in FIGS. 14 and 15, which illustrate the transverse pin mount 46 as a horseshoe shaped mount. As illustrated in FIG. 8 the transverse actuators 50 are operatively coupled to the tube 10. In one embodiment the transverse actuators 50 have an actuator tab 58 that is operatively coupled to a transverse actuator mount 54 located on the tube 10. In other embodiments of the invention, the transverse actuators 50 may be operatively coupled to the tube 10 using other means.

Figure 14:
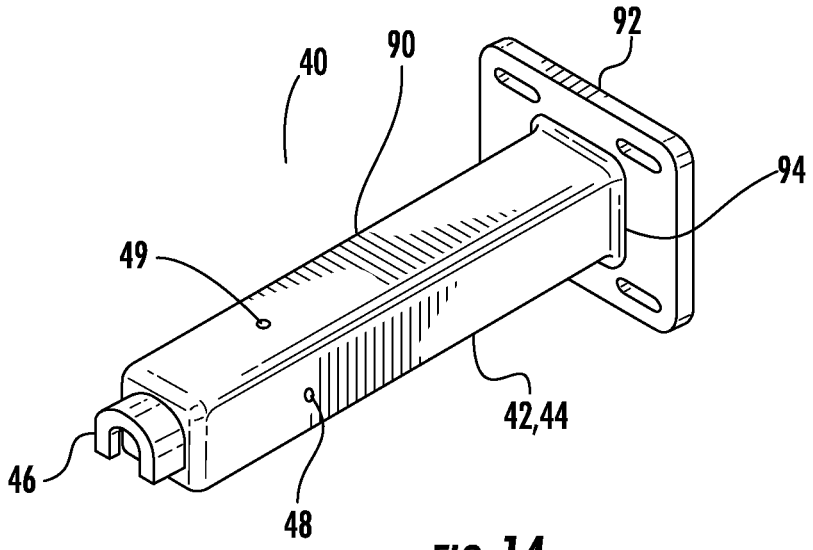
FIG. 14 illustrates a bottom perspective view of the support mount, in accordance with an embodiment of the invention.
Figure 15:
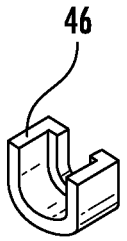
FIG. 15 illustrates a top perspective view of a transverse pin mount, in accordance with an embodiment of the invention.
Figure 16:
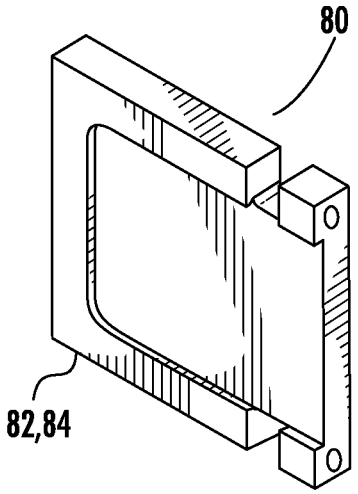
FIG. 16 illustrates a perspective view of a stand receiving plate, in accordance with an embodiment of the invention.
Figure 17:
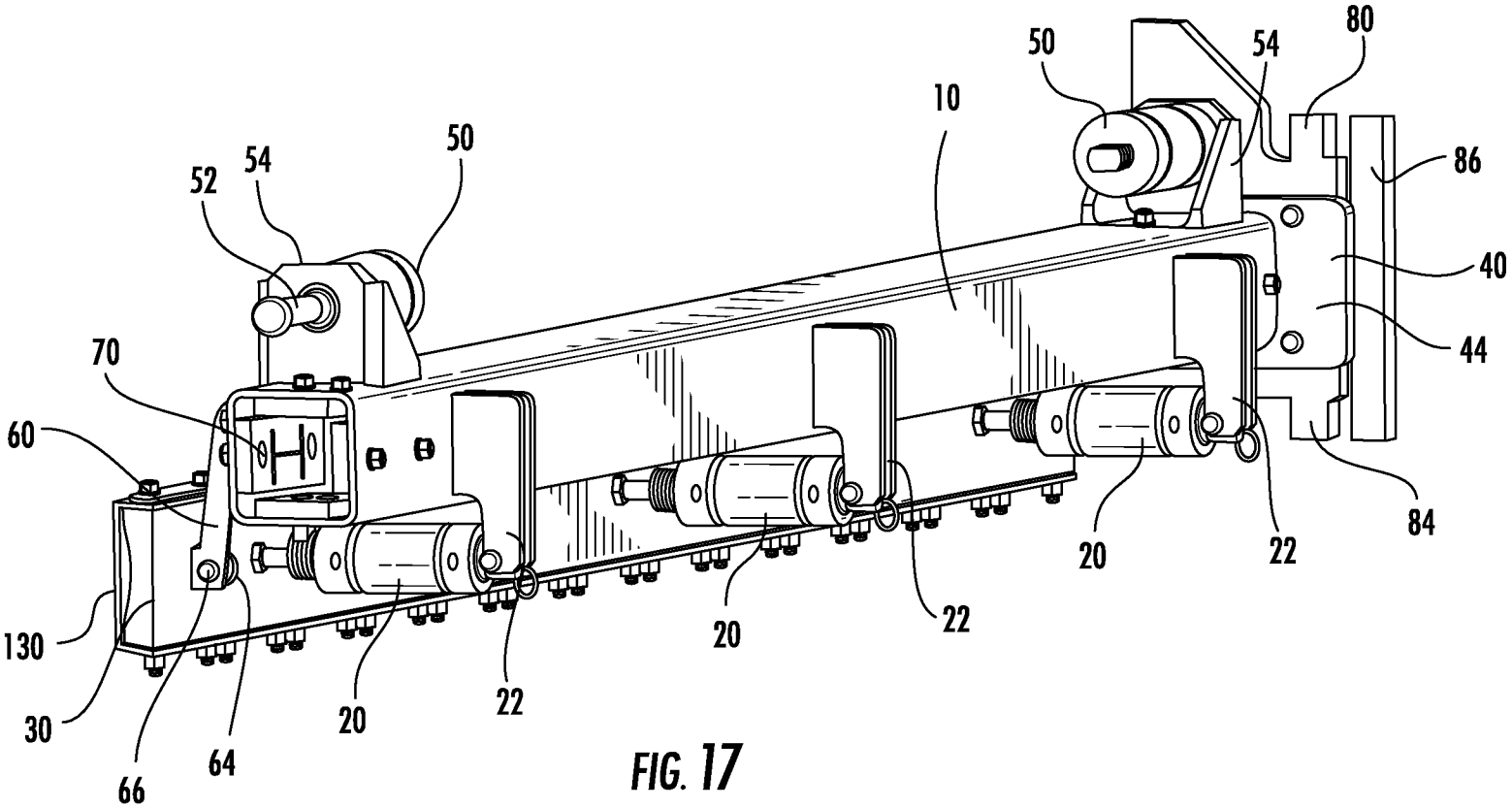
FIG. 17 illustrates a perspective view of a roll polisher with external transverse actuators, in accordance with an embodiment of the invention.
Figure 18:
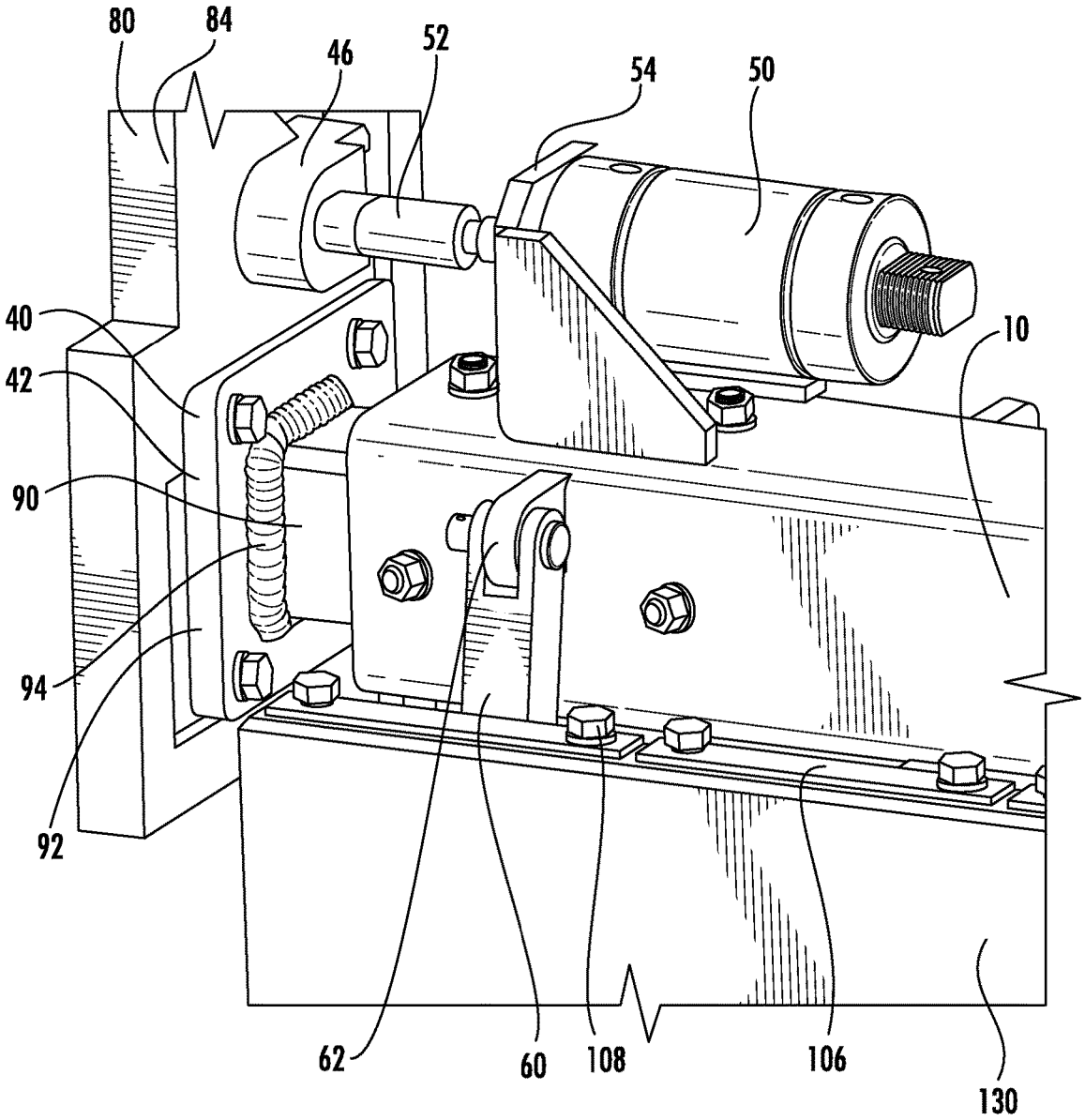
FIG. 18 illustrates a front perspective view of one end of a roll polisher with external transverse actuators, in accordance with an embodiment of the invention.
Figure 20:
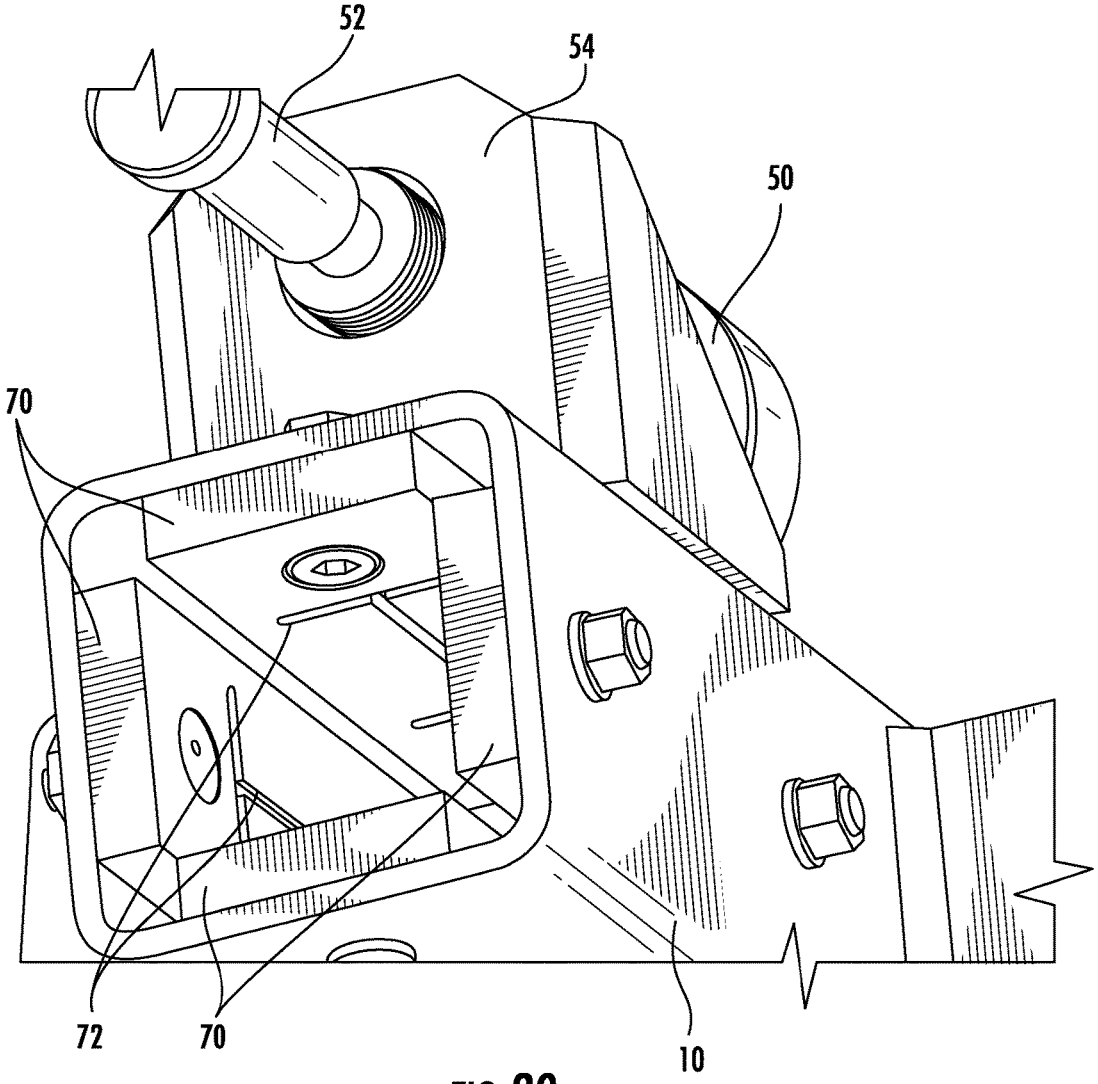
FIG. 20 illustrates a perspective view of one end of a tube and wear pads of a roll polisher, in accordance with an embodiment of the invention.
Figure 21:
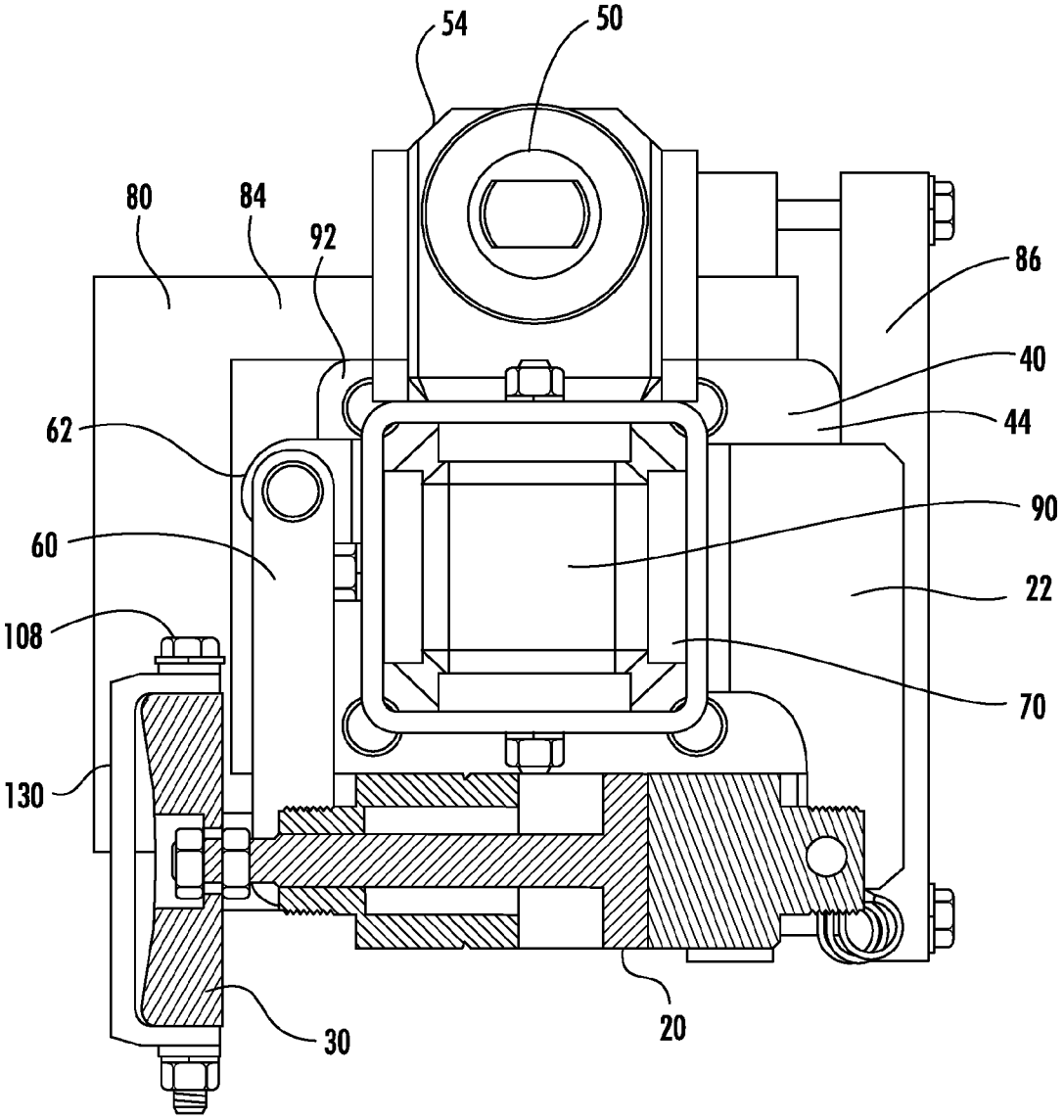
FIG. 21 illustrates a cross-sectional side view of a roll polisher with external transverse actuators, in accordance with an embodiment of the invention.

As illustrated in FIGS. 8 and 20, in some embodiments of the invention one or more wear pads 70 may be operatively coupled into the inside surface of the hollow first end 12 and second end 14 of the tube 10. In other embodiments of the invention the wear pads 70 may be operatively coupled to the outside of the support mounts 40. The wear pads 70 may be operatively coupled to the tube 10 through the use of couplings or fasteners, or other like means. The wear pads 70 may be made from a material that facilitates the sliding movement between the support mounts 40 and the tube 10. For example, the wear pads 70 may be plastic, teflon or teflon coated, or coated with another non-stick coating. In still other embodiments of the invention the mating surfaces between the support mounts 40 and the wear pads 70 may be lubricated. For example, as illustrated in FIGS. 8 and 20 the wear pads 70 may include one or more pad channels 72, such as H-shaped pad channels 72, or other like channels. In the embodiments illustrated in FIGS. 8 and 14 the support mounts 40 may have support mount channels 48 that are used to deliver lubrication from an area of the support mount 40 outside of the tube 10 to the one or more pad channels 72 on the surface of the wear pads 70. As illustrated by FIGS. 8 and 14 the support mount channels 48 may end in support mount apertures 49 on the outside surface of the support mounts 40 that deliver the lubrication to the wear pads 70. Therefore, in operation a lubrication tube may be coupled to the support mount 40 through a lubrication coupling 47 on the support mount 40. Alternatively, in an embodiment where the first end 12 and the second end 14 of the tube 10 are located at least partially within the support mount 40, the wear pads 70 may be operatively coupled to the inside of the support mount 40 or the outside of the tube 10.

The roll polisher 1 may be operatively coupled to the roll stand 4, or other support structure adjacent the rollers 2. In some embodiments the support mounts 40 may be operatively coupled directly to the roll stand 4 or other support structure adjacent the rollers 2. As illustrated in FIGS. 5, 6, 7, 11, 16, and 19, in some embodiments the support mounts 40 may be operatively coupled to receiving plates 80. The first receiving plate 82 and second receiving plate 84 are then operatively coupled to the roll stand 4 or other support structure adjacent the rollers 2, such as for example through the use of couplings. In one embodiment of the invention the support mounts 40 are operatively coupled to a recess within the receiving plates 80 through the use of couplings. Alternatively, or in addition to the couplings, the support mounts 40 may be secured within the receiving plate 80 through the use of a receiving bar 86.

Figure 10:
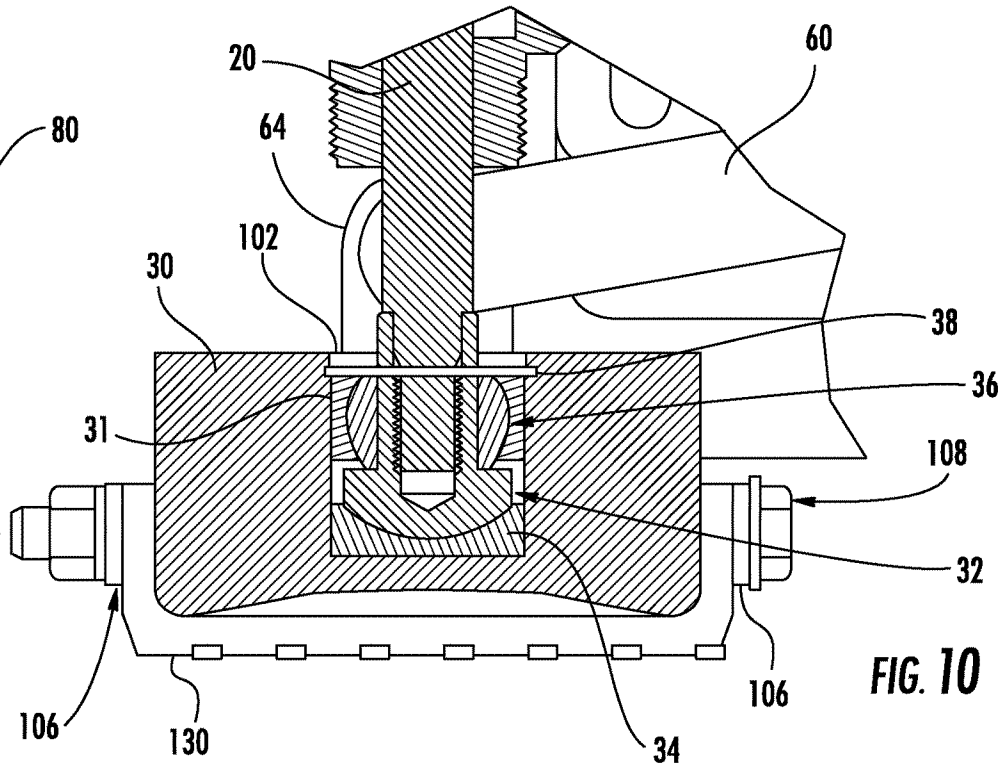
FIG. 10 illustrates an expanded cross-sectional view of the roll polisher illustrated in FIG. 9, in accordance with an embodiment of the invention.
Figure 9:
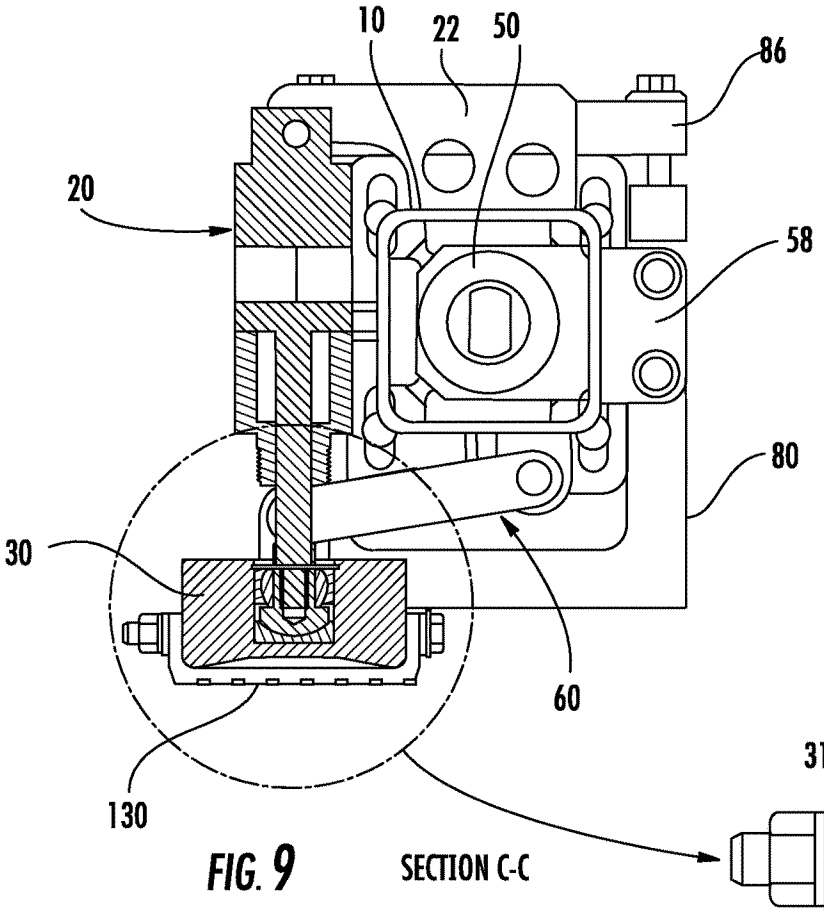
FIG. 9 illustrates a cross-sectional view of the roll polisher illustrated in FIG. 6, in accordance with an embodiment of the invention.
Figure 11:
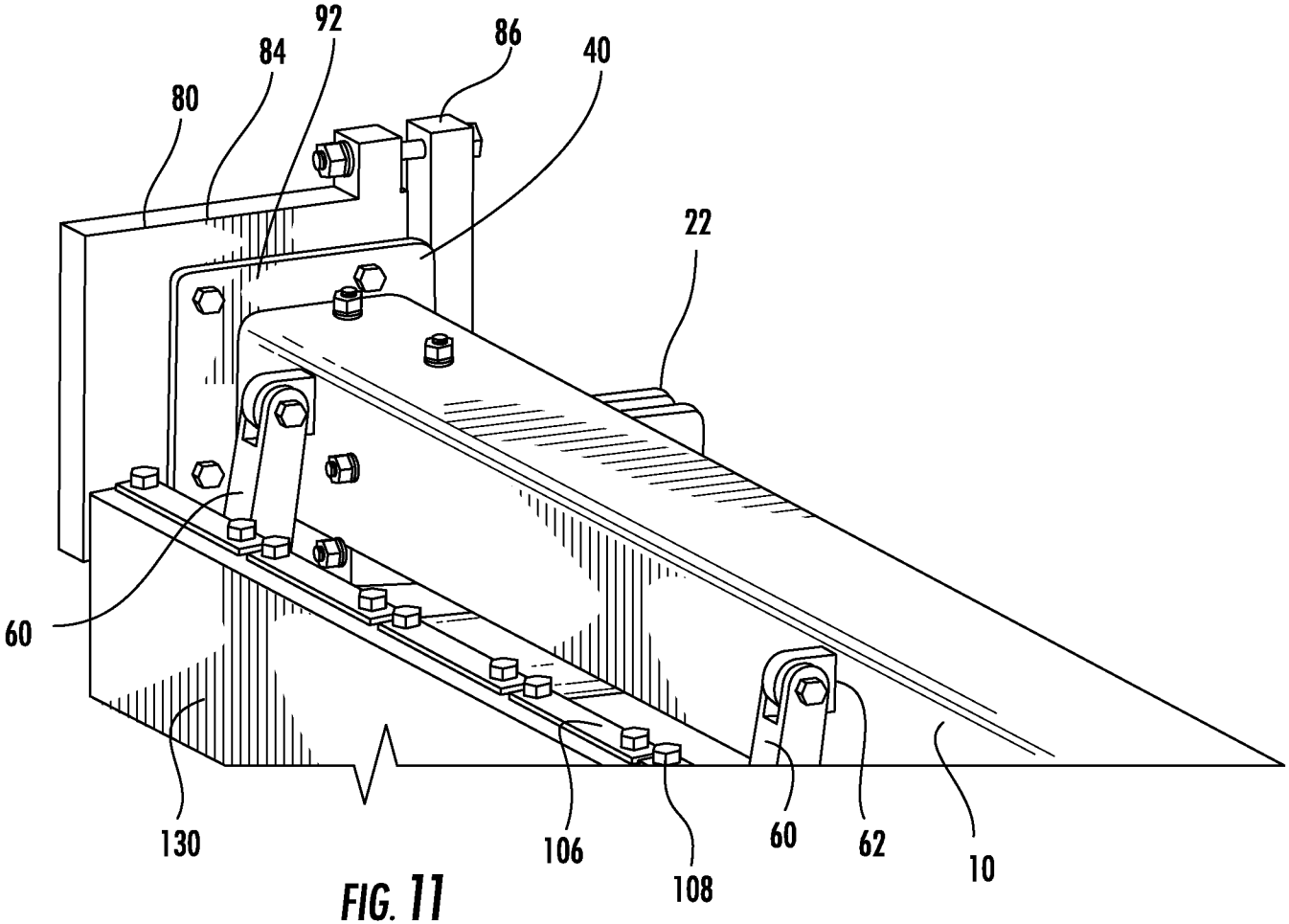
FIG. 11 illustrates a perspective view of an end of the roll polisher, in accordance with an embodiment of the invention.
Figure 12:
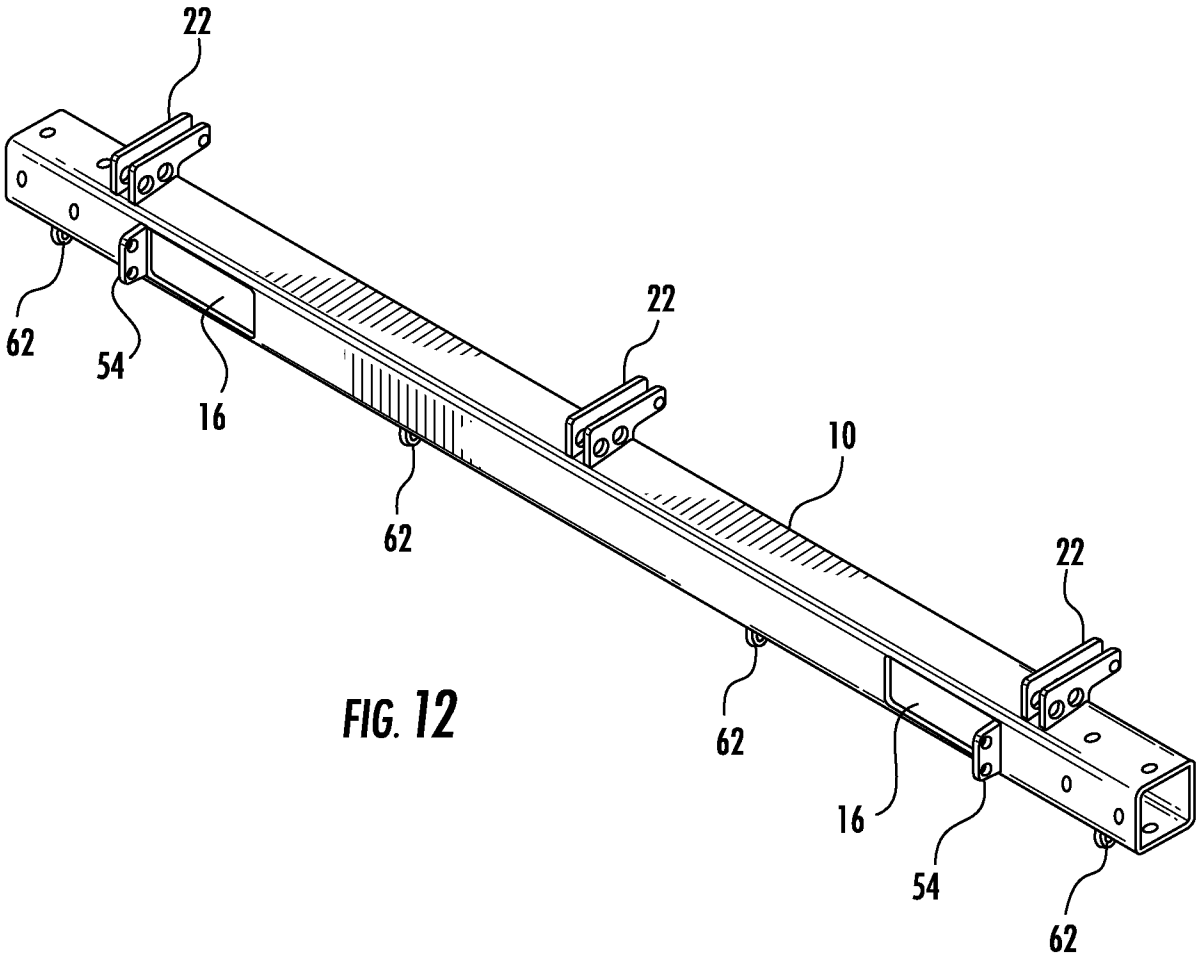
FIG. 12 illustrates a perspective view of the tube, in accordance with an embodiment of the invention.
Figure 13:
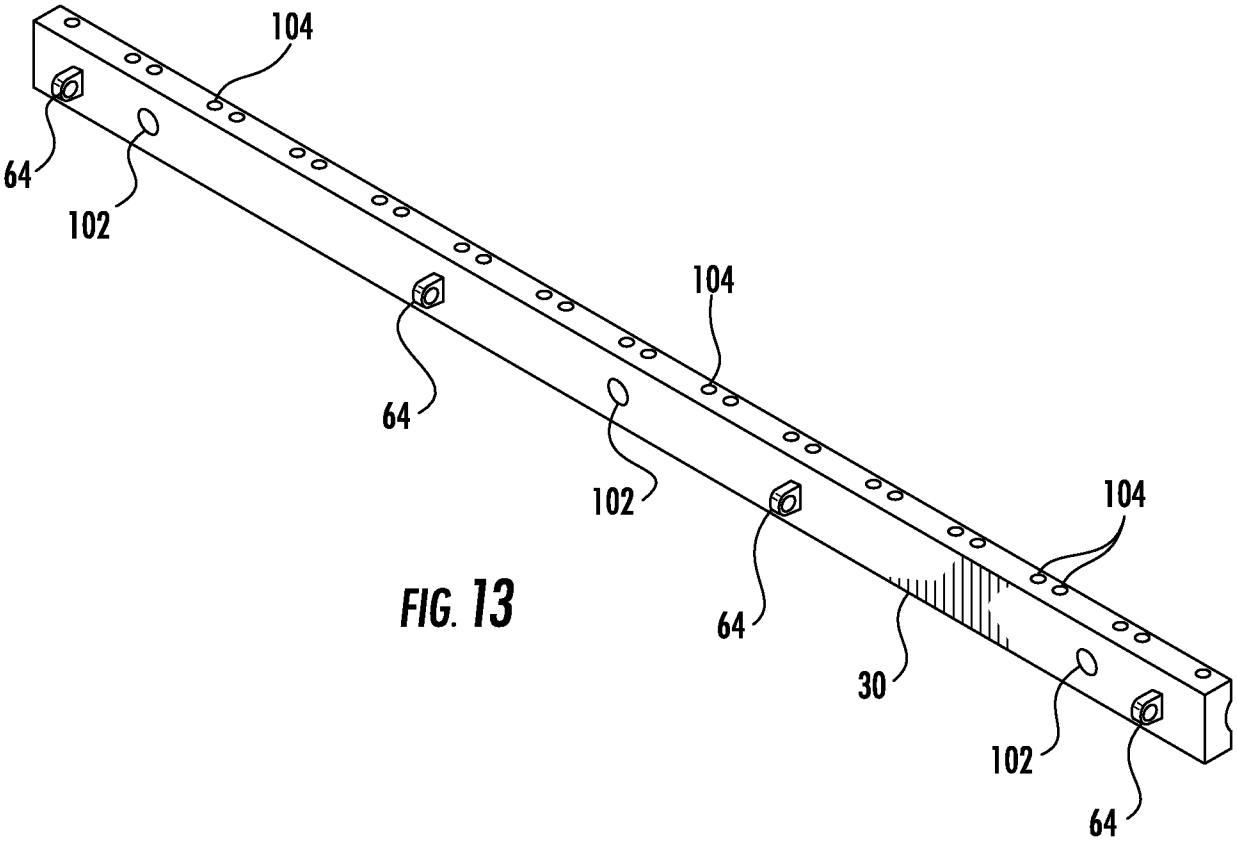
FIG. 13 illustrates a perspective view of the polishing bar, in accordance with an embodiment of the invention.

As illustrated by FIGS. 9 and 10 the pivot actuators 20 are operatively coupled to the polishing bar 30 and the tube 10. The pivot actuators 20 are operatively coupled to the tube 10 to through the use of a pivot tube mount 22, as illustrated in FIGS. 9 and 12. The pivot actuators 20 are operatively coupled to the polishing bar 30 through a pivot coupling 31 in a polishing tube aperture 102 that allows for misalignment of the roll polisher 1, or non-uniform actuation of the pivot actuators 20 upon engagement and disengagement with the rollers 2. As illustrated by FIGS. 9 and 10 the pivot coupling 31 comprises a bearing 36, a coupling head 32, a head seat 34, and a retaining ring 38. The actuating arm of the pivot actuator 20 may be operatively coupled to the coupling head 32, for example through a press fit, screwed connection, pinned connection, or other like connection. The coupling head 32 may be secured within a bearing 36 that allows the actuation arm of the pivot actuator 20 to rotate three-hundred sixty (360) degrees and tilt in any direction off of a center longitudinal axis through the actuation arm and pivot coupling 31. The coupling head 32 may be operatively coupled to (e.g., sit within, have interfacing surfaces, or the like) a head seat 34 that allows the coupling head 32 to pivot off of the center longitudinal axis. The head seat 34, coupling head 32, and bearing 36 may be at least partially located within a polishing bar aperture 102 in the polishing bar 30. Furthermore, the head seat 34, coupling head 32, and bearing 36 may be retained within the polishing bar aperture 102 through the use of a retaining ring 38. Furthermore, in some embodiments of the invention a linkage 60 is also used to operatively couple the polishing bar 30 to the tube 10. For example, as illustrated in FIGS. 1, 6, 9, and 11-13 the linkage 60 may be operatively coupled to the tube 10 through a tube linkage mount 62, and may be operatively coupled to the polishing bar 30 through a bar linkage mount 64. The linkage 60 may be utilized to reduce the transverse loading on the pivot actuators 20.

In operation, as the pivot actuators 20 are moved into engagement with the roller 2, a first end 132 of the polishing bar 30 may engage the roller 2 prior to a second end 134 of the polishing bar 30. Stresses on the pivot actuators 20 may be reduced or removed through the pivot coupling 31 because as the pivot actuators 20 extend the first end 132 of the polishing bar 30 may contact the roller 2, and thus, the pivot coupling 31 may allow the pivot actuators 20 to tilt or rotate to prevent damage to the pivot actuators before the rest of the polishing bar 30, including the second end 132 of the polishing bar 30, contacts the roller 2.

As illustrated by FIGS. 1, 9, 10, and 13 a polishing pad 130 may be operatively coupled to the polishing bar 30. The polishing pad 130 comprises the polishing surface that actually contacts the roller surfaces of the rollers 2 in order to polish the roller surfaces by removing defects and smoothing the roller surfaces. The polishing pad 130 may be a single pad or may be broken down into two or more pads. The polishing pad 130 is operatively coupled to the polishing bar 30, for example, through the use of couplings 104 (e.g., bolt and nut fasteners, or other like fasteners). In some embodiments of the invention a polishing pad plate 106 may be utilized to apply pressure to the polishing pad 130 to help clamp the polishing pad 130 to the polishing bar 30. In some embodiments of the invention the polishing pad 30 may have carved or embossed patterns in the polishing pad 30 in order to help facilitate removing defects and smoothing the roller surfaces of the rollers 2. In some embodiments the polishing pad 130 may be made of Kevlar, or another like material, that is both durable and able to polish the roller surfaces.

Figure 19:
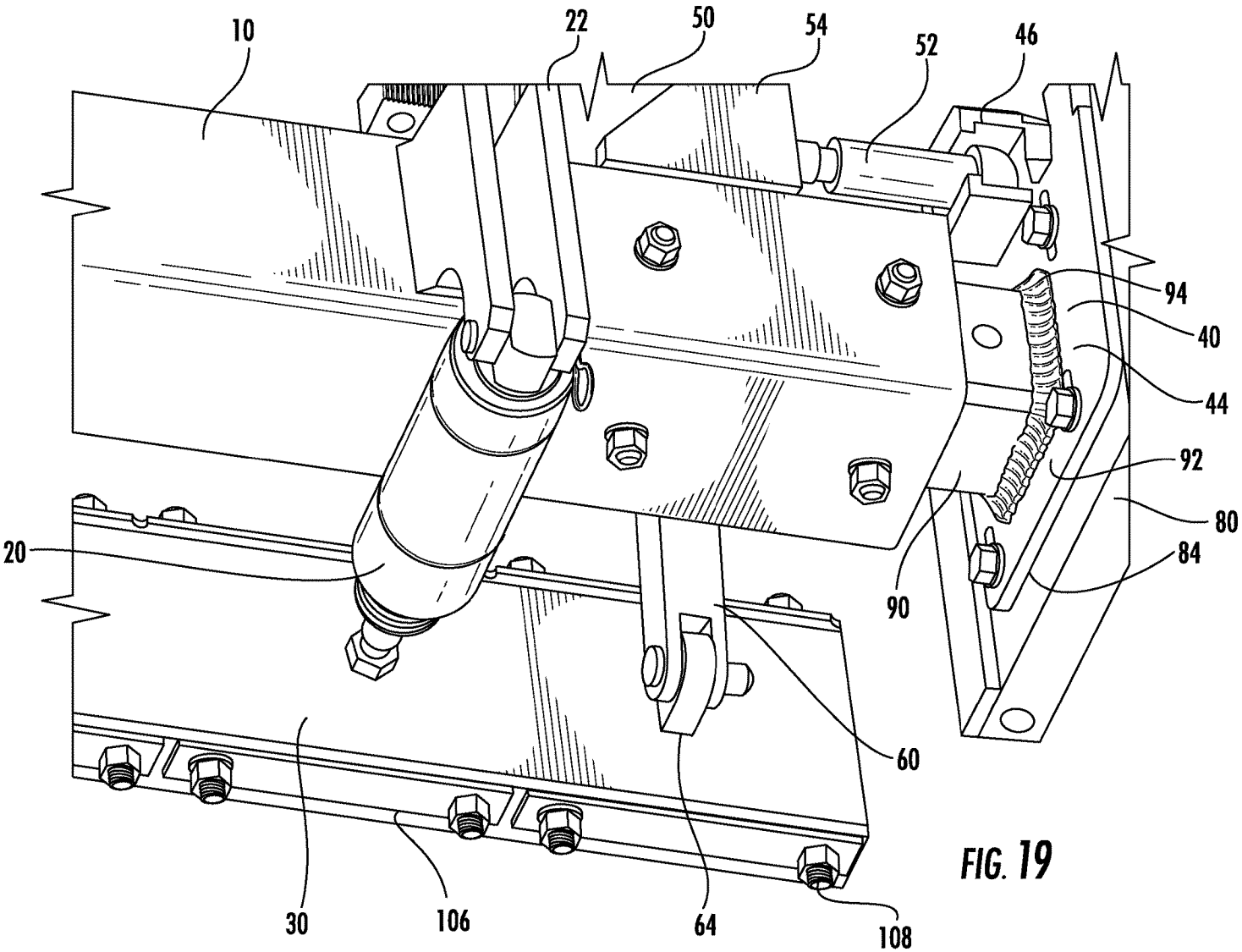
FIG. 19 illustrates a rear perspective view of one end of a roll polisher with external transverse actuators, in accordance with an embodiment of the invention.

FIGS. 17 through 21 illustrate another embodiment of the invention in which transverse actuators 50 are located at least partially on the outside of the tube 10 instead of at least partially within the tube 10. As illustrated in these embodiments of the invention the transverse actuator mount 54 is located on an outside surface of the tube 30. The transverse actuator mount 54, in one embodiment, may be welded to the tube 10, or otherwise be coupled to the tube 10. The transverse actuator mount 54 may have an aperture (e.g., hole) through which the transverse actuator arm of the transverse actuators 50 is located. As illustrated by FIG. 19 the actuator arm of transverse actuator 50 may comprise a transverse actuator pin 52 that is operatively coupled to the receiving plate 80 through the use of a transverse pin mount 46. In other embodiments of the invention the transverse pin mount 46 may be operatively coupled to the support plate 92 of the support mount 40. Although FIGS. 17 through 21 illustrate another embodiment of the roll polisher 1, the roll polisher 1 in FIGS. 17 through 21 work in the same way as described with respect to FIGS. 1 through 16.

Figure 22:
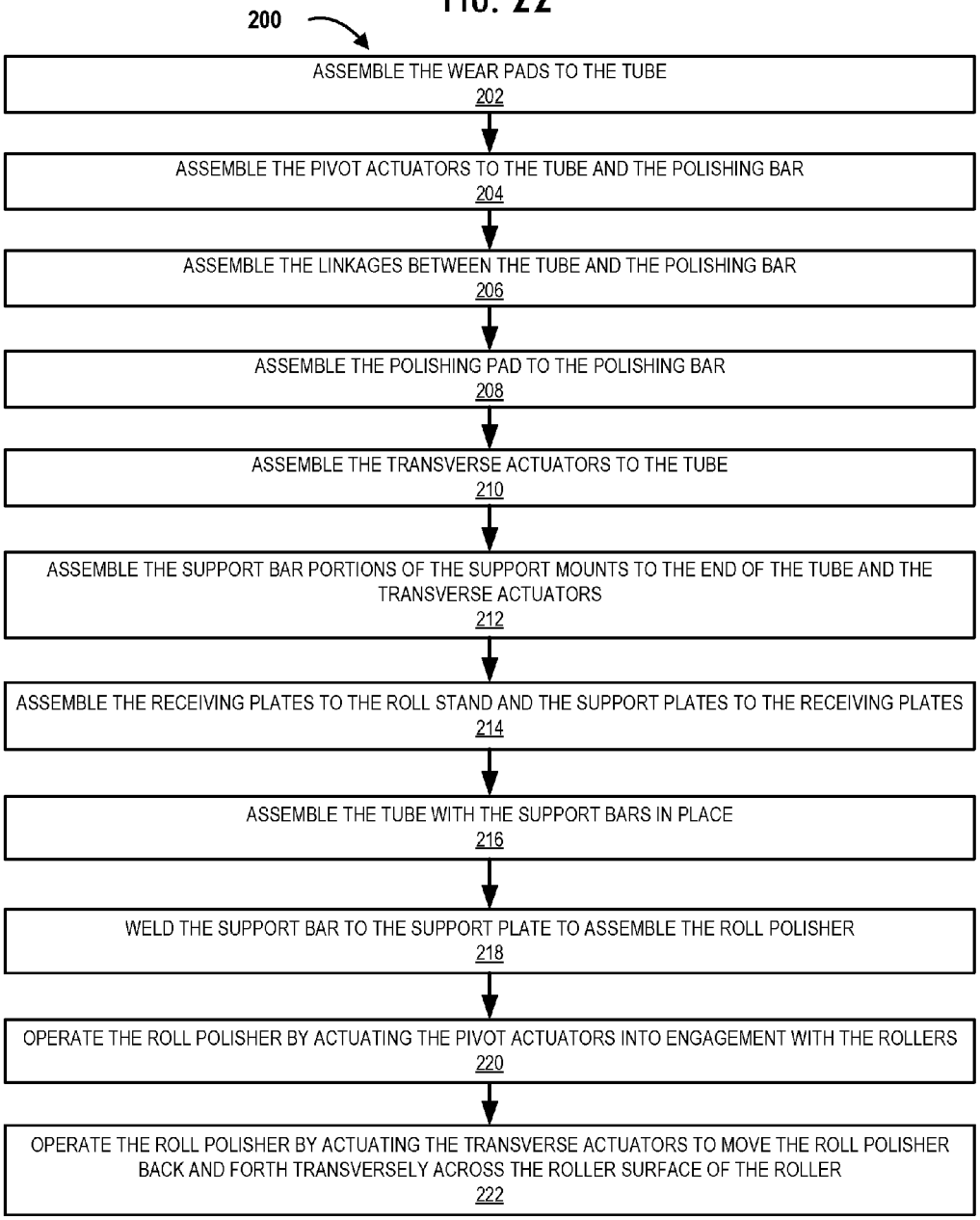
FIG. 22 illustrates a roll polisher assembly process, in accordance with one embodiment of the invention.

In order to assemble and use the roll polisher 1 within the tight tolerances of the of rolling stands 4, in some embodiments of the invention the roll polisher 1 may be assembled according to the roll polisher assembly and use process 200 of FIG. 22, which may be used in order to properly orient the roll polisher 1 with respect to the rollers 2. As illustrated by block 202 of FIG. 22, the wear pads 70 are assembled to the tube 10, for example through the use of couplings. As illustrated by block 204 the pivot actuators 20 are operatively coupled to the tube 10 and the polishing bar 30. For example, the pivot actuators 20 may be operatively coupled to the tube 10 through the pivot actuator tube mounts 22 using pivot pins 26. As previously described, the pivot actuators 20 may be operatively coupled to the polishing bar 30 through the use of a pivot coupling 31. In other embodiments of the invention the pivot actuators 20 may be operatively coupled to the tube 10 and/or the polishing bar 30 using different means.

As illustrated by block 206 of FIG. 22, the linkages 60 are operatively coupled to the tube 10 and the polishing bar 30. For example the linkages 60 are operatively coupled to the tube 10 through the tube linkage mount 62, and operatively coupled to the polishing bar 30 through a bar linkage mount 64 using linkage pins 66. As illustrated by block 208 the polishing pad 130 is operatively coupled to the polishing bar 30. For example, the polishing pad 130 is operatively coupled to the polishing bar 30 through the use of couplings 104 and polishing pad plates 106 that clamp or pinch the edges of the polishing pad 130 to the polishing bar 30.

As illustrated by block 210 the transverse actuator 50 is operatively coupled to the tube 10 (either on the inside or outside of the tube 10). In the embodiments in which the transverse actuator 50 is located within the tube 10, the transverse actuator 50 includes, or is coupled to, an actuator tab 58. The transverse actuator 50 is positioned within the tube 10 through the tube opening 16, and the actuator tab 58 is utilized to operatively couple the transverse actuator 50 to a transverse actuator mount 54 that is located on the tube 10. In the embodiments in which the transverse actuator 50 is located outside of the tube 10, the transverse actuator 50 is operatively coupled to the transverse actuator mount 54, such as directly to the transverse actuator mount 54 or secured within an aperture in the transverse actuator mount 54. As illustrated by block 212 each of the support bars 90 of the support mounts 40 are operatively coupled to the first end 12 and second end 14 of the tube 10. In this embodiment, the support bars 90 are not coupled to the support plates 92 of the support mounts 40. For example, in an embodiment in which the transverse actuators 50 are located at least partially within the tube 10, the support bars 90 are inserted into the hollow ends of the tube 10, and the transverse pin mounts 46, which are operatively coupled to the end of the support bars 90, are operatively coupled to the transverse actuator pin 52 of the transverse actuators 50.

As further illustrated by block 214 of FIG. 22, the receiving plates 80 are assembled to the roll stand 4 or other support location adjacent to the rollers 2. Furthermore, the support plates 92 of the support mounts 40 are operatively coupled to the receiving plates 80. For example, the receiving plates 80 may be coupled to a support location adjacent the rollers 2 using couplings, welding, or other like coupling means. The support plates 92 may be operatively coupled to the receiving plates 80 using couplings, sliding notched coupling, or other like coupling means.

After the receiving plates 80 and the support plates 92 are assembled and in the proper position, the assembled tube 10 with the support bars 90 assembled into the tube 10 is lifted into the proper orientation with the polishing bar in an extended engaged position with the surface of the roller 2. As such, the tube 10, the support bars 90, and the polishing bar 30 are located in the proper position for installation. The ends of the support bars 90 are then welded to the support plate 92 in order to orient the roll polisher 1 in the desired orientation. This assembly procedure allows for the assembly of the roll polisher 1 in the desired orientation to allow the polishing pad 130 to engage and disengage the polishing pad 130 with the surface of the rollers 2. In other embodiments of the invention instead of welding the support bars 90 to the support plates 92 to create the support mount 40, the support bars 90 may be coupled to the support plates 92 using couplings, or other like means. This may allow the positioning of the polishing pad 130 with respect to the surface of the roller 2 to change in order to properly locate and orient the roll polisher 1. As illustrated in FIG. 14 the attachment holes of the support mount 40 may be slots to allow for adjustment and fine tune positioning of the roll polisher 1 in the desired orientation.

After the roll polisher 1 is installed the hydraulic or pneumatic couplings may be attached to the pivot actuators 20 and transverse actuators 50. In other embodiments of the invention the hydraulic or pneumatic couplings may be operatively coupled to the pivot actuators 20 and transverse actuators 50 before the roll polisher 1 is installed in order to engage the rolling pad 130 with the roller 2 before the support bar 90 is operatively coupled to the support plate 92.

When the roll polisher 1 is installed and the actuators are connected to the control system, the pivot actuators may be actuated into place in order to engage the rolling surface of the rollers 2, as illustrated by block 220 of FIG. 22. Block 222 of FIG. 22 illustrates that the transverse actuators may also be actuated on an ongoing back and forth movement in order to allow the polishing pad 130 to move in a transverse direction to polish the rolling surface of the rollers 2 as the rollers are rotating in operation.

Specific embodiments of the invention are described herein. Many modifications and other embodiments of the invention set forth herein will come to mind to one skilled in the art to which the invention pertains, having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. Although specific terms are employed herein, they are used in a generic and descriptive sense only and not for purposes of limitation.

What is claimed is:

1. A roll polisher apparatus, comprising:

a tube with a first end and a second end;

a pivot actuator;

a polishing bar operatively coupled to the tube through at least the pivot actuator, wherein the pivot actuator allows the polishing bar to be extended and retracted;

a pivot coupling, wherein the pivot actuator is operatively coupled to the polishing bar through the pivot coupling, wherein the pivot coupling allows the pivot actuator to rotate in any direction and tilt off of center in any direction with respect to the polishing bar;

a first support mount operatively coupled to the first end of the tube and a second support mount operatively coupled to the second end of the tube; and a transverse actuator operatively coupled to the tube and at least one of the first support mount or the second support mount to allow transverse movement between the tube and the first and second support mounts.

2. The roll polisher apparatus of claim 1, further comprising:

a transverse pin mount operatively coupled to the first support mount; and a transverse pin operatively coupled to the transverse actuator, wherein the transverse actuator is operatively coupled to the transverse pin mount of the first support mount through the transverse pin.

3. The roll polisher apparatus of claim 1, wherein the polishing bar is operatively coupled to the tube through two or more pivot actuators.

4. The roll polisher apparatus of claim 1, further comprising:

a transverse actuator aperture in the tube; and a transverse actuator mount operatively coupled to the tube, wherein the transverse actuator is positioned at least partially within the tube and operatively coupled to the transverse actuator mount.

5. The roll polisher apparatus of claim 1, wherein the pivot coupling comprises:

a coupling head operatively coupled to the pivot actuator;

a coupling head seat located within the polishing bar and configured to interact with the coupling head;

a bearing operatively coupled to the coupling head; and a retaining ring configured to operatively couple the coupling head, the coupling head seat, and the bearing to the polishing bar.

6. The roll polisher apparatus of claim 1, further comprising:

a linkage operatively coupling the tube to the polishing bar to reduce transverse shear loading on the pivot actuator.

7. The roll polisher apparatus of claim 1, further comprising:

one or more tube wear pads operatively coupled to the first end or the second end of the tube, wherein the one or more tube wear pads comprise wear pad channels for receiving and distributing lubrication across the one or more wear pads.

8. The roll polisher apparatus of claim 7, wherein at least one of the a first support mount or the second support mount comprises:

support mount channels, wherein the support mount channels receive the lubrication and deliver the lubrication to the wear pad channels in the one or more wear pads.

9. The roll polisher apparatus of claim 1, further comprising:

a first stand receiving plate and a second stand receiving plate, wherein the first stand receiving plate is operatively coupled to the first support mount and the second stand receiving plate is operatively coupled to the second support mount.

10. The roll polisher apparatus of claim 9, wherein at least one of the first support mount or the second support mount comprise:

a support mounting plate; and a support bar welded to the support mounting plate, wherein the support mounting plate is assembled to the stand receiving plate, the support bars are assembled to the tube, the roll polisher apparatus is held in position adjacent a roll, and the support bar is welded to the support mounting plate to orient the roll polisher apparatus adjacent the roll.

11. The roll polisher apparatus of claim 1, further comprising:

a transverse pin mount operatively coupled to the first support mount or a first stand receiving plate;

a transverse pin operatively coupled to the transverse actuator;

a transverse actuator mount operatively coupled to the tube, wherein the transverse actuator is positioned at least partially outside of the tube and operatively coupled to the transverse actuator mount and operatively coupled to the transverse pin mount of the first support mount or the first stand receiving plate through the transverse pin.

12. A roll polisher apparatus, comprising:

a tube with a first end and a second end;

one or more pivot actuators;

a polishing bar operatively coupled to the tube through at least the one or more pivot actuators, wherein the one or more pivot actuators allow the polishing bar to be extended and retracted for engagement and disengagement with a surface of a roller;

a first support mount operatively coupled to the first end of the tube;

a second support mount operatively coupled to the second end of the tube;

a first transverse actuator aperture located at the first end of the tube;

a first transverse actuator mount operatively coupled to the first end of the tube;

a first transverse actuator located at least partially within the first end of the tube;

a first transverse pin mount operatively coupled to the first support mount;

a first transverse pin operatively coupled to the first transverse actuator;

wherein the first transverse actuator is operatively coupled to the first support mount through the first transverse pin operatively coupled to the first transverse pin mount; and wherein the first transverse actuator allows for transverse movement between the tube and the first support mount and the second support mount to move the roll polishing bar back and forth transversely with respect to the surface of the roller.

13. The roll polisher apparatus of claim 12, further comprising:

a second transverse actuator aperture located at the second end of the tube;

a second transverse actuator mount operatively coupled to the second end of the tube;

a second transverse actuator located at least partially within the second end of the tube and operatively coupled to the second transverse actuator mount at the second end of the tube;

a second transverse pin mount operatively coupled to the second support mount; and a second transverse pin operatively coupled to the second transverse actuator;

wherein the second transverse actuator is operatively coupled to the second support mount through the second transverse pin operatively coupled to the second transverse pin mount; and wherein the second transverse actuator allows the transverse movement between the tube and the first support mount and the second support mount.

14. The roll polisher apparatus of claim 12, further comprising:

one or more pivot couplings operatively coupling the one or more pivot actuators to the polishing bar, wherein the one or more pivot couplings each comprise:

a coupling head operatively coupled to the pivot actuator;

a coupling head seat located within the polishing bar and configured to interact with the coupling head;

a bearing operatively coupled to the coupling head; and a retaining ring configured to operatively couple the coupling head, the coupling head seat, and the bearing to the polishing bar.

15. The roll polisher apparatus of claim 12, further comprising:

a linkage operatively coupling the tube to the polishing bar to reduce transverse shear loading on the one or more pivot actuators.

16. The roll polisher apparatus of claim 12, further comprising:

one or more tube wear pads operatively coupled to the first end and the second end of the tube, wherein the one or more tube wear pads comprise wear pad channels for receiving and distributing lubrication across the one or more wear pads.

17. The roll polisher apparatus of claim 16, wherein the first support mount and the second support mount comprise:

support mount channels, wherein the support mount channels receive the lubrication and deliver the lubrication to the wear pad channels in the one or more wear pads.

18. The roll polisher apparatus of claim 12, further comprising:

a first stand receiving plate and a second stand receiving plate, wherein the first stand receiving plate is operatively coupled to the first support mount and the second stand receiving plate is operatively coupled to the second support mount.

19. The roll polisher apparatus of claim 18, wherein the first support mount and the second support mount comprise:

a support mounting plate; and a support bar welded to the support mounting plate, wherein the support mounting plate is assembled to the stand receiving plate, the support bar is assembled to the tube, the roll polisher apparatus is held in position adjacent a roll, and the support bar is welded to the support mounting plate to orient the roll polisher apparatus adjacent the roll.

20. A roll polisher apparatus, comprising:

a tube with a first end and a second end;

at least one pivot actuator;

a polishing bar operatively coupled to the tube through the at least one pivot actuator, wherein the at least one pivot actuator allows the polishing bar to be extended and retracted;

a first support mount operatively coupled to the first end of the tube and a second support mount operatively coupled to the second end of the tube;

at least one transverse actuator operatively coupled to the tube and at least one of the first support mount or the second support mount to allow transverse movement between the tube and the first and second support mounts; and one or more tube wear pads operatively coupled to the first end or the second end of the tube or the first support mount or the second support mount, wherein the one or more tube wear pads comprise wear pad channels for receiving and distributing lubrication across the one or more wear pads.

21. A roll polisher apparatus, comprising:

a tube with a first end and a second end;

at least one pivot actuator;

a polishing bar operatively coupled to the tube through the at least one pivot actuator, wherein the at least one pivot actuator allows the polishing bar to be extended and retracted;

a first support mount operatively coupled to the first end of the tube and a second support mount operatively coupled to the second end of the tube, wherein at least one of the first support mount or the second support mount is inserted at least partially within the first end or the second end of the tube;

at least one transverse actuator operatively coupled to the tube and at least one of the first support mount or the second support mount to allow transverse movement between the tube and the first support mount and the second support mount; and support mount channels within the first support mount or the second support mount, wherein the support mount channels receive lubrication and deliver the lubrication to a portion of the first support mount or the second support mount located within the first end of the tube or the second end of the tube.

* * * * *